US011097924B2

(12) United States Patent
Blanchard

(10) Patent No.: US 11,097,924 B2
(45) Date of Patent: Aug. 24, 2021

(54) HAND DETECTION FOR ELEVATOR OPERATION

(71) Applicant: Otis Elevator Company, Farmington, CT (US)

(72) Inventor: Arnaud Blanchard, Région Centre (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 654 days.

(21) Appl. No.: 15/993,846

(22) Filed: May 31, 2018

(65) Prior Publication Data

US 2018/0354746 A1 Dec. 13, 2018

(30) Foreign Application Priority Data

Jun. 7, 2017 (EP) ..... 17305671

(51) Int. Cl.

*B66B 3/00* (2006.01)
*B66B 1/46* (2006.01)
*B66B 1/52* (2006.01)

(52) U.S. Cl.

CPC ..... *B66B 3/002* (2013.01); *B66B 1/461* (2013.01); *B66B 1/468* (2013.01); *B66B 1/52* (2013.01); *B66B 2201/4638* (2013.01)

(58) Field of Classification Search

CPC ..... B66B 3/006; B66B 2201/463; B66B 3/00; B66B 3/002; B66B 1/3415; B66B 1/468;

(Continued)

(56) References Cited

U.S. PATENT DOCUMENTS 5,308,943 A 5/1994 Screven et al.
5,551,533 A * 9/1996 Ng ..... B66B 3/00 187/390

(Continued)

FOREIGN PATENT DOCUMENTS

CN 102267653 A 12/2011
CN 102701033 A 10/2012

(Continued)

OTHER PUBLICATIONS

European Office Action, European Application No. 17305671.4, dated Jul. 30, 2020, European Patent Office; European Office Action 4 pages.

(Continued)

*Primary Examiner* — Marlon T Fletcher
(74) *Attorney, Agent, or Firm* — Cantor Colburn LLP

(57) ABSTRACT

Elevator systems and operating methods including an elevator operating panel having at least one button and an audio orientation system. The audio orientation system includes at least one speaker positioned proximate the elevator operating panel and a proximity sensor associated with an associated button and positioned proximate thereto, the proximity sensor arranged to generate a button detection zone around the associated button and detect a presence within the button detection zone. When a detection is made by the proximity sensor regarding a presence with the button detection zone, the audio system controls the at least one speaker to generate an audio orientation signal comprising button information that is related to the associated button within the button detection zone.

13 Claims, 6 Drawing Sheets

(58) Field of Classification Search
CPC .... B66B 2201/4638; B66B 2201/4661; B66B 13/146; B66B 1/52; B66B 2201/00
See application file for complete search history.

(56) References Cited

U.S. PATENT DOCUMENTS

| | | | | |
|---|---|---|---|---|
| 6,161,655 | A | 12/2000 | Lejon et al. | |
| 8,872,387 | B2 | 10/2014 | Yoon | |
| 8,890,846 | B2 | 11/2014 | Rostamianfar et al. | |
| 9,122,351 | B2 | 9/2015 | McKiel | |
| 9,624,071 | B2 | 4/2017 | Hanvey et al. | |
| 2002/0121984 | A1 | 9/2002 | Tsukamoto et al. | |
| 2015/0232300 | A1* | 8/2015 | Preston | B66B 1/461 187/395 |
| 2016/0103500 | A1* | 4/2016 | Hussey | B25J 13/084 345/173 |
| 2016/0311647 | A1* | 10/2016 | Peterson | B66B 1/46 |
| 2017/0144859 | A1* | 5/2017 | Scoville | G06K 9/6202 |
| 2018/0111792 | A1* | 4/2018 | Schach | B66B 3/002 |
| 2018/0127234 | A1* | 5/2018 | Lofberg | G06F 3/016 |
| 2018/0312369 | A1* | 11/2018 | Blanchard | B66B 3/006 |
| 2018/0354746 | A1* | 12/2018 | Blanchard | B66B 1/461 |
| 2019/0133851 | A1* | 5/2019 | Bezault | B66B 3/004 |
| 2019/0284020 | A1* | 9/2019 | Gireddy | B66B 3/008 |

FOREIGN PATENT DOCUMENTS

| | | | |
|---|---|---|---|
| CN | 105270944 | A | 1/2016 |
| CN | 106006258 | A | 10/2016 |
| CN | 205772554 | U | 12/2016 |
| JP | H02147577 | A | 6/1990 |
| JP | 2000211832 | A | 8/2000 |
| JP | 2005145607 | A | 6/2005 |
| JP | 2006056700 | A | 3/2006 |
| KR | 20110032591 | A | 3/2011 |
| KR | 2020130004629 | U | 7/2013 |
| KR | 20160064522 | A | 6/2016 |
| WO | 2007046807 | A1 | 4/2007 |
| WO | 2012101772 | A1 | 8/2012 |
| WO | 2015183256 | A1 | 12/2015 |

OTHER PUBLICATIONS

European Search Report, European Application No. 17305671.4, dated Jan. 3, 2018, European Patent Office; European Search Report 8 pages.

Montanaro et al. "A touchless human-machine interface for the control of an elevator", Accessed via the internet on May 1, 2017; 8 pages.

* cited by examiner

HAND DETECTION FOR ELEVATOR OPERATION

CROSS-REFERENCE TO RELATED APPLICATIONS

This application claims the benefit of European Application No. 17305671.4, filed Jun. 7, 2017, which is incorporated herein by reference in its entirety.

BACKGROUND

The subject matter disclosed herein generally relates to elevator cars and, more particularly, hand detection systems for operating elevator systems.

Entering and exiting elevator cars can be difficult for persons with disabilities, such as being sight impaired, or for persons carrying large objects. Such persons may enter an elevator car not knowing where an elevator car operating panel is located or which buttons may provide which functionality. Thus, a sight-impaired passenger may not be able to easily use such elevators. Further, it may be difficult for a sight-impaired person to call an elevator. It may be advantageous to provide improved mechanisms for such passengers to obtain the information they require for operating and using elevator systems.

SUMMARY

According to some embodiments, elevator systems are provided. The elevator systems include an elevator operating panel having at least one button and an audio orientation system. The audio orientation system includes at least one speaker positioned proximate the elevator operating panel and a proximity sensor associated with an associated button and positioned proximate thereto, the proximity sensor arranged to generate a button detection zone around the associated button and detect a presence within the button detection zone. When a detection is made by the proximity sensor regarding a presence with the button detection zone, the audio system controls the at least one speaker to generate an audio orientation signal comprising button information that is related to the associated button within the button detection zone.

In addition to one or more of the features described herein, or as an alternative, further embodiments of the elevator systems may include that the associated button comprises a first portion and a second portion, wherein the first portion is an interactive element and the second portion comprises the proximity sensor of the associated button.

In addition to one or more of the features described herein, or as an alternative, further embodiments of the elevator systems may include the proximity sensor is one of a magnetic proximity sensor, a motion detection proximity sensor, a heat sensing proximity sensor, or a light sensing proximity sensor.

In addition to one or more of the features described herein, or as an alternative, further embodiments of the elevator systems may include that the audio orientation system further includes at least one additional sensor arranged to generate a panel detection zone, wherein the panel detection zone is larger than the button detection zone.

In addition to one or more of the features described herein, or as an alternative, further embodiments of the elevator systems may include that the at least one additional sensor is a camera.

In addition to one or more of the features described herein, or as an alternative, further embodiments of the elevator systems may include that the elevator operating panel is a hall call panel and the associated button is a direction button to make an elevator service request.

In addition to one or more of the features described herein, or as an alternative, further embodiments of the elevator systems may include that the elevator operating panel is a car operating panel and the associated button is a floor selection button of the car operating panel.

In addition to one or more of the features described herein, or as an alternative, further embodiments of the elevator systems may include that the at least one speaker is housed within the elevator operating panel.

In addition to one or more of the features described herein, or as an alternative, further embodiments of the elevator systems may include an elevator controller that receives input at the associated button regarding elevator requests.

According to some embodiments, methods of operating elevator systems are provided. The elevator system includes an elevator operating panel and an audio orientation system. The methods include detecting a presence within a button detection zone with a proximity sensor, wherein the button detection zone is associated with an associated button of the elevator operating panel and generating an audio orientation signal from at least one speaker, wherein the audio orientation signal includes button information indicating information associated with the associated button where the presence is detected.

In addition to one or more of the features described herein, or as an alternative, further embodiments of the methods may include detecting a presence within a panel detection zone and generating an audio orientation signal providing information associated with the elevator operating panel.

In addition to one or more of the features described herein, or as an alternative, further embodiments of the methods may include receiving an input at the associated button where the presence is detected and controlling an elevator car in response to the input.

In addition to one or more of the features described herein, or as an alternative, further embodiments of the methods may include generating a third audio orientation signal indicating selection of the associated button where the presence is detected.

In addition to one or more of the features described herein, or as an alternative, further embodiments of the methods may include that the elevator operating panel is a hall call panel and the associated button is a direction button to make an elevator service request.

In addition to one or more of the features described herein, or as an alternative, further embodiments of the methods may include that the elevator operating panel is a car operating panel and the associated button is a floor selection button of the car operating panel.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
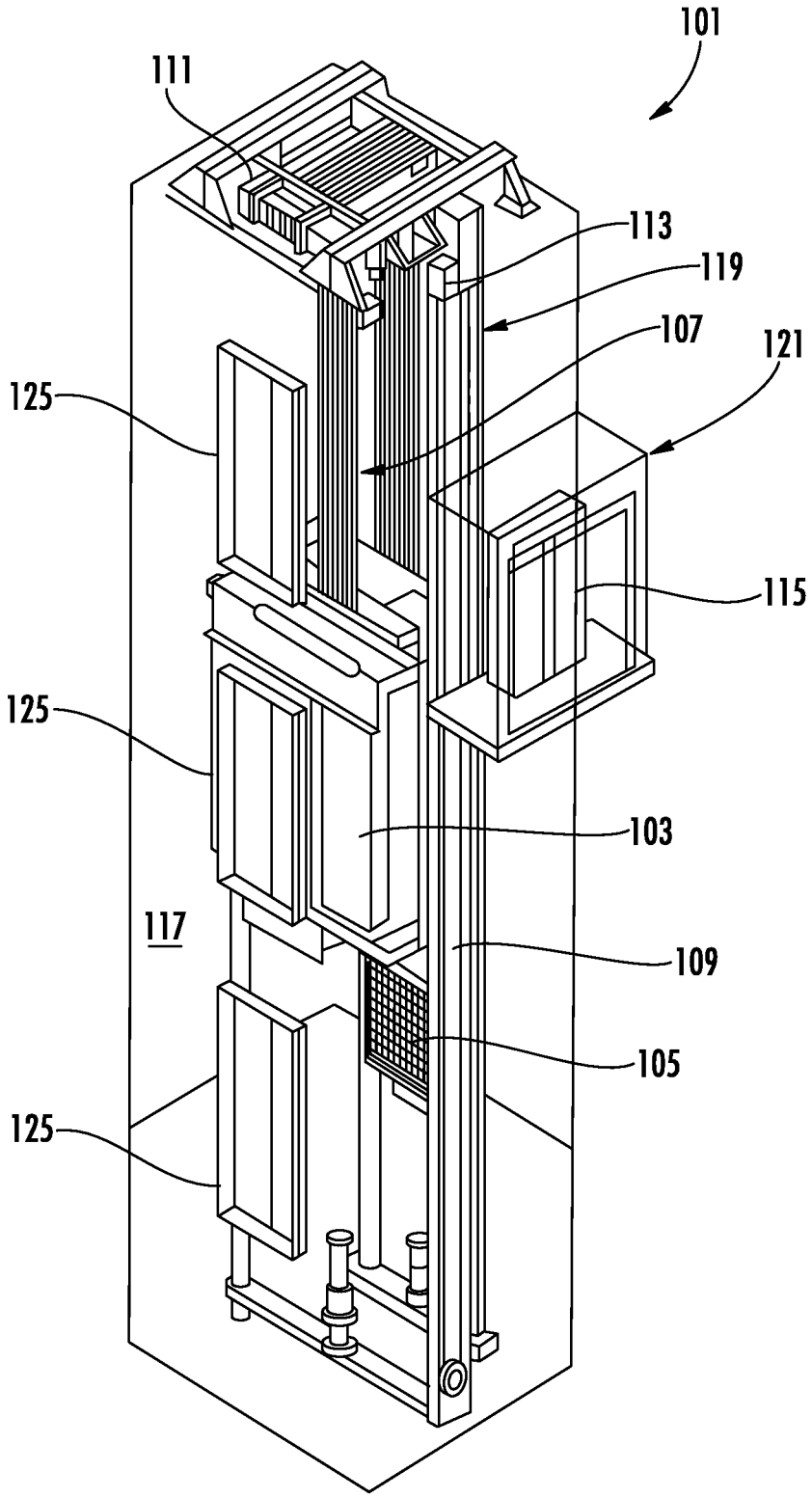
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which may be part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101, such as inside a landing cabinet located at a landing.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes. For example, ropeless elevator systems, hydraulic elevator systems, etc. may incorporate embodiments of the present disclosure.

Figure 2A:
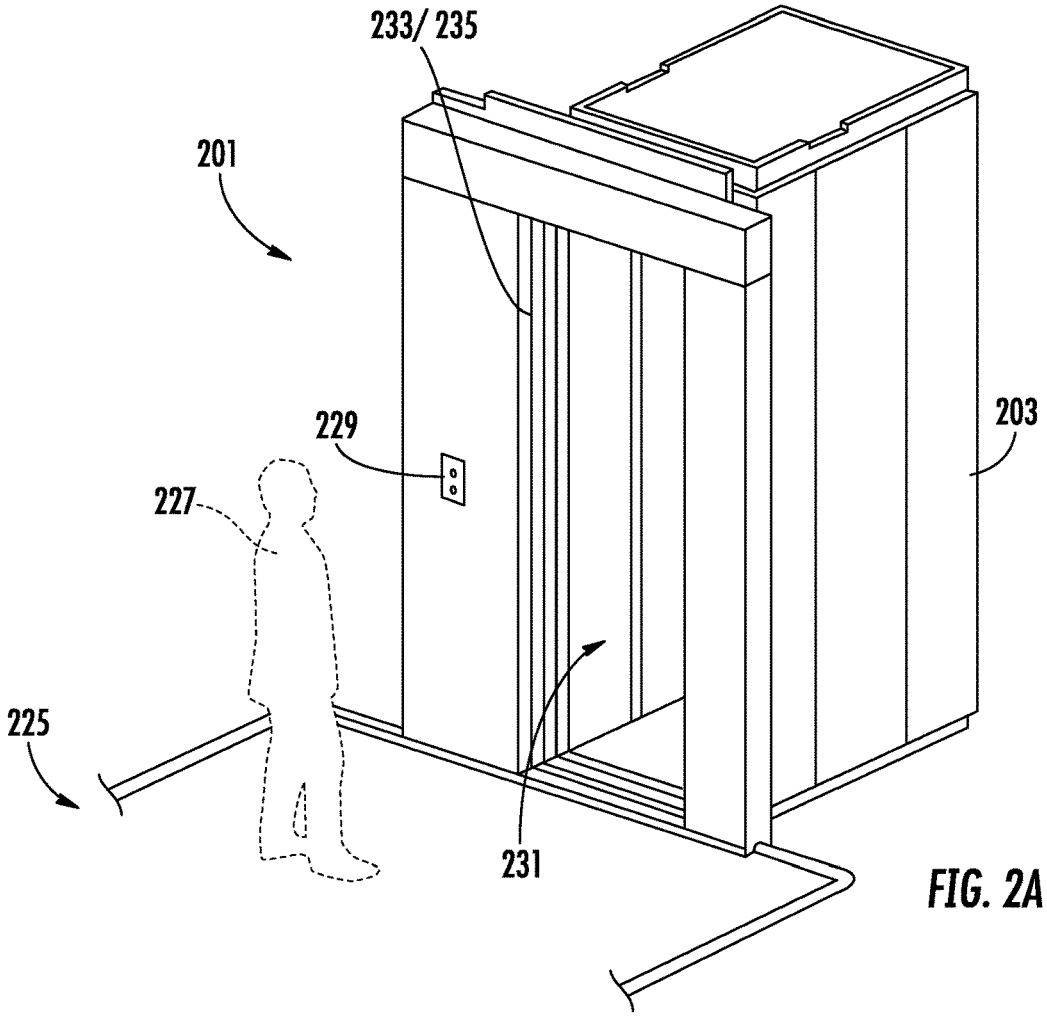
FIG. 2A is a schematic illustration of a landing floor of an elevator system with a hall call panel that may employ various embodiments of the present disclosure.
Figure 2B:
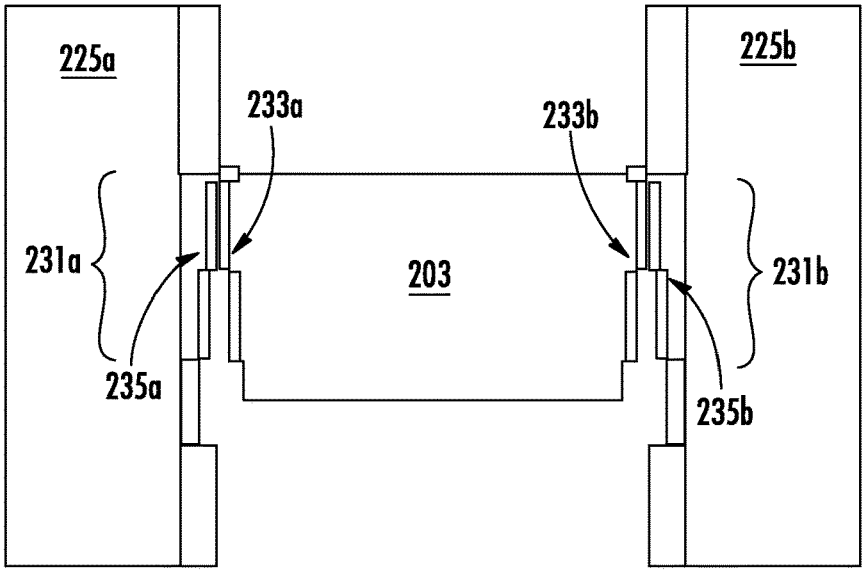
FIG. 2B is a plan view illustration of the elevator system of FIG. 2A illustrating first and second side landings and entrances.

FIG. 2A is a schematic illustration of an elevator system 201 that may incorporate embodiments disclosed herein, and FIG. 2B is a top-down view illustrating front and rear doors on an elevator car 203 and at a landing 225. As shown in FIG. 2A, an elevator car 203 is located at a landing 225. The elevator car 203 may be called to the landing 225 by a passenger 227 that desires to travel to another floor within a building using a hall call panel 229. The passenger 227 can enter or exit the elevator car 203 through an entrance 231 which has an elevator car door 233 and a landing door 235 that operate in tandem when at the landing 225. Those of skill in the art will appreciate that in some configurations, the elevator car 203 can include elevator car doors 233 at two entrances, typically opposite each other, to enable "front" and "rear" loading/unloading from the elevator car 203, depending on the location of a landing door 235 and the configuration of the particular landing.

For example, FIG. 2B illustrates a top down view of the elevator car 203 of FIG. 2A at the landing 225. As shown, the landing 225 has a first side 225*a* (e.g., front side) and a second side 225*b* (e.g., rear side). When the elevator car 203 is located at the landing 225, a first elevator car door 233*a* is positioned adjacent a first landing door 235*a* at the first side 225*a* of the landing 225, and when opened form a first entrance 231*a*. Similarly, a second elevator car door 233*b* is positioned adjacent a second landing door 235*b* at the second side 225*b* of the landing 225, and when opened form a second entrance 231*b*.

Blind or otherwise sight-impaired passengers may have difficulties using elevators, particularly elevators having two separate entrances. One such difficulty may arise related to operation of car operating panels within an elevator car and/or elevator hall call panels (e.g., hall call panel 229). One possible solution to aid sight-impaired passengers may be to provide audio speakers to provide audio commands, sounds, information, etc. that may aid the sight-impaired passenger in using the elevator. However, such solutions may not eliminate all confusion of sight-impaired passengers, especially related to operation of elevator buttons, either located at a landing or within an elevator car. Accordingly, embodiments provided herein are directed to improved systems for audio orientation within elevator systems.

Figure 3:
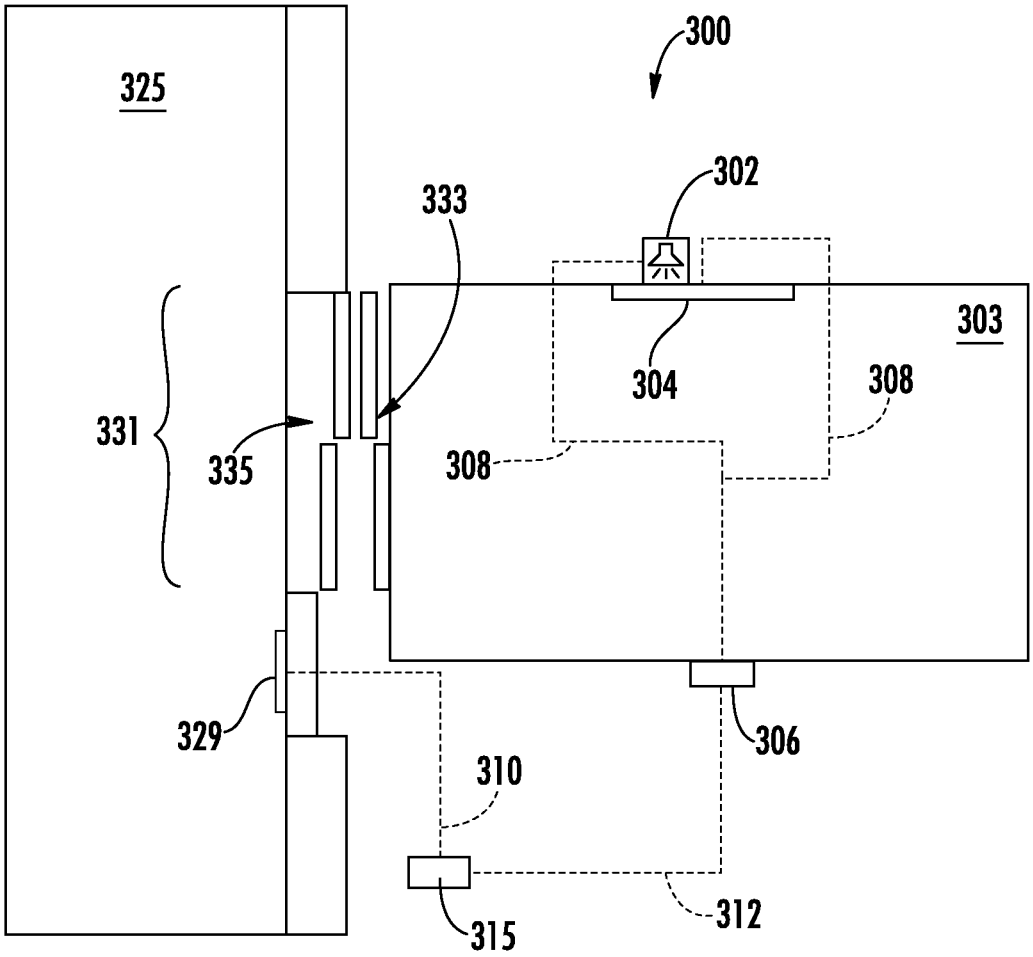
FIG. 3 is a schematic illustration of an elevator car having an audio orientation system installed in accordance with an embodiment of the present disclosure.

Turning now to FIG. 3, a schematic illustration of an elevator car 303 having an audio orientation system 300 installed therein is shown. As shown, the elevator car 303 has an elevator car door 333 which aligns with a landing door 335 at a landing 325. The elevator car door 333 and the landing door 335 define an entrance 331 that is openable to enable loading/unloading from the elevator car 303 at the landing 325. The audio orientation system 300 includes a car operating panel speaker 302 installed proximate to and/or as part of a car operating panel 304. The car operating panel 304 can include a plurality of buttons that are provided to enable passengers control the elevator car 303, such as to request destination floors to travel to, open and/or close the elevator car door 333, call for help, and/or provide other functionality. The car operating panel speaker 302 is arranged and controlled to generate audio such as floor information, intercom functionality (e.g., in an emergency), music, or other auditory functionality. In some embodiments of the present orientation the car operating panel speaker 302 can output personalized voice indications or auditory instructions and/or sounds to safely guide and orient a sight-impaired passenger relative to the car operating panel 304.

An elevator car controller 306 is in communication with the car operating panel 304 and the car operating panel speaker 302. As shown, a communication connection 308 is established between the elevator car controller 306 and the car operating panel 304 and the car operating panel speaker 302. The communication connection 308 may be a wired and/or wireless communication connection using any known communications protocols and/or techniques. The elevator car controller 306 includes various electrical components, including, but not limited to, a processor, memory, electrical buses, communication components, etc. The elevator car controller 306 can receive user inputs at the car operating panel 304 and further can control output of the car operating panel speaker 302 in accordance with embodiments of the present disclosure. As described herein, the elevator car controller 306 is configured to control an audio orientation output from the car operating panel speaker 302 and further can control the specific output from the car operating panel speaker 302 (e.g., synthesized voice communications/instructions, sounds, audio indicators, etc.). In some embodiments, the elevator car controller 306 can be integrated into the car operating panel 304 or may be integrated and/or part of other electronics and/or control systems associated with the elevator car 303 or corresponding elevator system. In other embodiments, the elevator car controller 306 can be mounted on an exterior of the elevator car 303 as a discrete device.

As shown, the landing 325 includes a hall call panel 329 which includes various electronic components as will be appreciated by those of skill in the art. As schematically shown, an elevator system controller 315 is shown operably connected to the hall call panel 329 by communication connection 310. The hall call panel 329 is arranged to receive inputs from users located at the landing 325 that are requesting elevator service. The input is transmitted to the elevator system controller 315 which then controls operation of the elevator car 303 in line with the user request. Further, as shown, the elevator system controller 315 is operably connected to the elevator car controller 306 through communication connection 312. The input received at the car operating panel 304 may be transmitted through the elevator car controller 306 to the elevator system controller 315 such that the elevator car 303 is controlled in response to user inputs at the car operating panel 304.

As noted above, sight-impaired passengers, whether located on the landing 325 or within the elevator car 303, may have difficulty in using the hall call panel 329 and/or the car operating panel 304. Such difficulty may arise from an inability to see which specific buttons they are pressing when physically located in front of the respective panel 304, 329. Embodiments of the present disclosure are arranged to provide improved auditory information related to proximity to buttons of the panels 304, 329.

Figure 4:
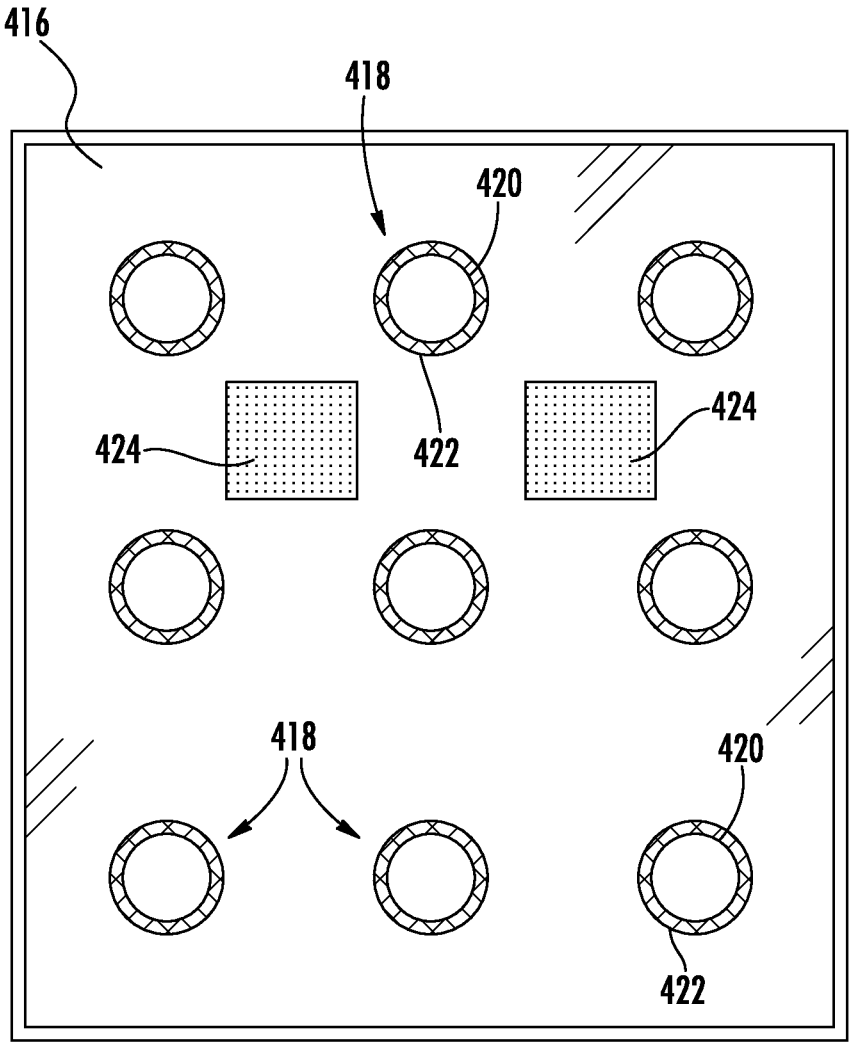
FIG. 4 is a schematic illustration of an elevator operating panel arranged in accordance with an embodiment of the present disclosure.

Turning now to FIG. 4, a schematic illustration of an elevator operating panel 416 is shown. The elevator operating panel 416 is representative of a hall call panel or a car operating panel. As shown, the elevator operating panel 416 includes a plurality of buttons 418 that are operable to make requests by users of an elevator system. For example, the buttons 418 may be directional call buttons, such as those located on hall call panels, or may be floor entry buttons, such as those located on car operating panels. The direction call buttons may be direction buttons (e.g., have an arrow indicator) to make elevator service requests for travel in the indicated direction. The floor entry buttons may be floor selection buttons with alphanumerical indicators thereon that provide information about destination and enable an ability to make elevator service requests to travel to a specific destination. The illustrative arrangement shown in FIG. 4 is not intended to be limiting, but rather is provided for illustrative and explanatory purposes.

To aid sight-impaired passengers of the elevator operating panel 416, the buttons 418 of the elevator operating panel 416 include a detection functionality. As shown, the buttons 418 include a first portion 420 and a second portion 422. The first portion 420 is an interactive element, such as a press-button or other types of interactive element that a passenger can touch or press to make a request of the elevator system associated with the specific button (e.g., directional request from a landing or requesting travel to a specific floor from within an elevator car). The second portion 422 of the buttons 418 are proximity sensors that can detect the presence of a person or object in proximity to the specific button 418. The proximity sensors (second portion 422) can be sensors arranged to detect persons/things in proximity based on magnetic sensing, motion sensing, heat sensing, light sensing, or other proximity means. As shown, the second portion 422 surrounds the first portion 420. However, in some embodiments, the first and second portions 420, 422 can form a unitary button such that the sensing is integrated into the press-button.

Also shown in FIG. 4, the elevator operating panel 416 includes optional speakers 424. The speakers 424 can generate auditory sounds associated with detection made by the second portions 422 of the buttons 418. For example, the speakers 424 can output information associated with a request that would be generated by operation of the button 418 at which the detection is made. Thus, a sight-impaired passenger can be provided with auditory instructions and/or information associated with operation of the elevator operating panel 416.

In some embodiments, the auditory functionality of the elevator operating panel 416 may be provided through control and communication with an elevator car controller and/or an elevator system controller such as that shown and described with respect to FIG. 3. Further, in some embodiments, a car operating panel speaker may be used that is not specifically integrated into or part of the button portion of a panel. That is, as will be appreciated by those of skill in the art, a car operating panel speaker may be located away from the buttons on a car operating panel. Such speaker may be used to provide auditory information as described herein. Moreover, other speakers of elevator systems may be used without departing from the scope of the present disclosure.

Figure 5:
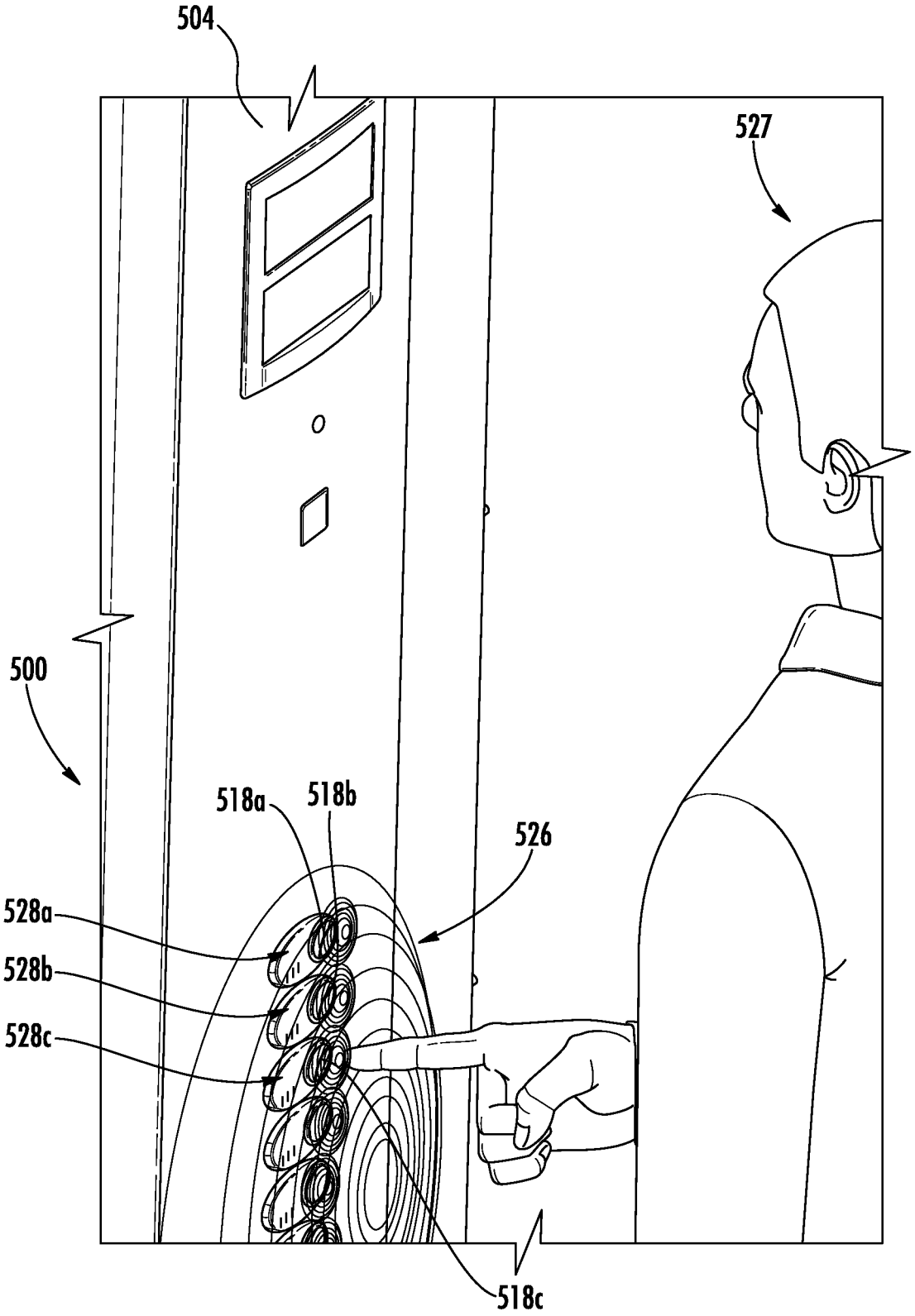
FIG. 5 is a schematic illustration of a passenger using an elevator system in accordance with an embodiment of the present disclosure.

Turning now to FIG. 5, a schematic illustration of a sight-impaired passenger 527 using a car operating panel 504 arranged with an audio orientation system 500 in accordance with the present disclosure is shown. As shown, the car operating panel 504 includes a plurality of buttons

518*a*, 518*b*, 518*c* that can be interacted with by the passenger 527 to make requests, such as destinations of travel (e.g., floor).

In the system of FIG. 5, two levels or zones of detection are provided. A panel detection zone 526 is provided to detect when a passenger is in proximity to the car operating panel 504. The panel detection zone 526 can be provided by various mechanisms, such as visual or other proximity detection of a person or object within a space around the car operating panel 504. For example, optical sensors or cameras can be employed to generate the panel detection zone 526. In other embodiments, various types of proximity sensors (such as those described above) may be employed to form the panel detection zone 526 around the buttons 518*a*, 518*b*, 518*c* of the car operating panel 504.

When the passenger 527 is detected within the panel detection zone 526, button detection zones 528*a*, 528*b*, 528*c* may be activated by a controller (e.g., an elevator car controller or other controller associated with the audio orientation system 500). Each button detection zone 528*a*, 528*b*, 528*c* is individually associated with a respective button 518*a*, 518*b*, 518*c*. The buttons 518*a*, 518*b*, 518*c* can be configured similar to that shown in FIG. 4 having a first portion for interaction and a second portion for generating a respective button detection zone 528*a*, 528*b*, 528*c*. The detection zones 526, 528*a*, 528*b*, 528*c* may be generated by elements that are in communication with a controller of the audio orientation system 500. In some embodiments, the button detection zones 528*a*, 528*b*, 528*c* are only active when a passenger is present. That is, a first detection in the panel detection zone 526 will trigger activation of the button detection zones 528*a*, 528*b*, 528*c*.

In operation, when a detection is made within the panel detection zone 526, a speaker can be controlled to provide auditory information to the passenger. For example, a speaker may output words such as "please approach car operating panel" or something similar. The output may be controlled to provide directional orientation to the passenger, such that by hearing the auditory information, the passenger will know the direction to turn/walk to enable interaction with the operating panel.

Once the passenger raises their hand or other object toward the buttons 518*a*, 518*b*, 518*c*, their hand will enter the button detection zones 528*a*, 528*b*, 528*c*, which can then provide specific auditory information related to the detection. For example, a characteristic assigned to a specific button 518*a*, 518*b*, 518*c* can be presented through the speakers of the system. If the passenger 527 holds their hand or finger close to one of the buttons 518*a*, 518*b*, 518*c*, the associated button detection zones 528*a*, 528*b*, 528*c* will detect an object in proximity (e.g., finger, hand, items, etc.) and a speaker can output specific information. The speaker may, in one non-limiting example, output words such as "pointing at Floor 2 button" or something similar. If the passenger actuates the specific button, then the speakers can output a confirmation such as "Floor 2 selected." However, if the passenger moves their hand without selecting the presently indicated button, the system will then output a different auditory information associated with a detection made within a different button detection zone. The auditory information is generated live or in real-time by the effect of the hand or the finger passing inside the respective button detection zone 528*a*, 528*b*, 528*c* and enables a passenger easily select a desired destination and/or operation.

Although FIG. 5 is illustrative of a car operating panel, embodiments provided herein can be applied to elevator hall call panels, which may include only "up" and "down" options for calling an elevator car. Further, although described with respect to selecting a destination floor, embodiments provided herein can be applied to any type of button, such as emergency call buttons, open/close door, etc., as will be appreciated by those of skill in the art.

Figure 6:
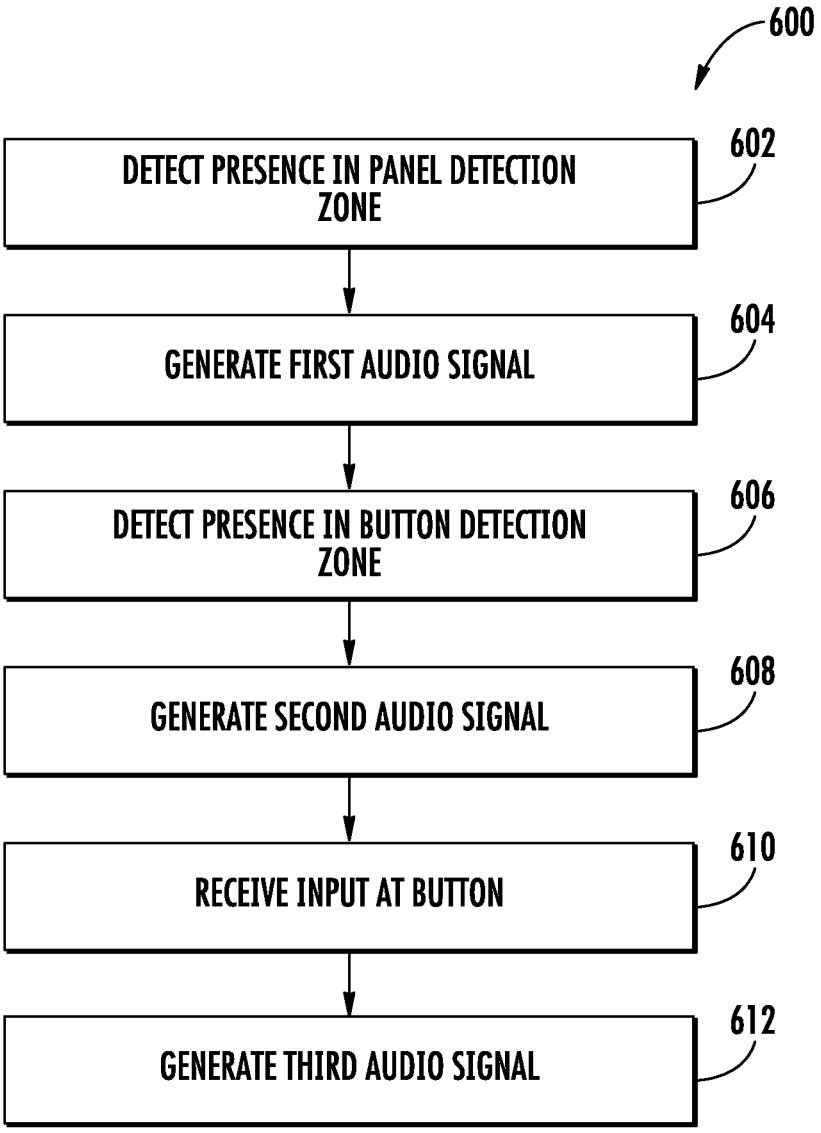
FIG. 6 is a flow process for operating an elevator system in accordance with an embodiment of the present disclosure.

Turning now to FIG. 6, a flow process 600 for operating an audio orientation system for an elevator system in accordance with an embodiment of the present disclosure is shown. The flow process 600 can be performed within and/or as part of a system as shown and described above. In accordance with some embodiments, the audio orientation system includes at least one controller, at least one speaker, and an elevator operating panel having one or more buttons having associated proximity sensors. The audio orientation system can further include one or more additional detection sensors that are associated with an area or volume around the elevator operating panel. The elevator operating panel can be a car operating panel or a hall call panel of an elevator system. The buttons of the elevator operating panel are used to make requests for elevator service or for other functions, as will be appreciated by those of skill in the art.

At block 602, a first sensor or set of sensors makes a detection within a panel detection zone. The panel detection zone is a predefined volume or area around, near, and proximate to the elevator operating panel. The panel detection zone is defined by and monitored by one or more panel zone detection sensors that are arranged to detect when a passenger approaches the elevator operating panel.

At block 604, when a detection is made within the panel detection zone, the system generates a first audio orientation signal to provide information to a passenger within the panel detection zone. The first audio orientation signal may be an auditory instruction to encourage the passenger to approach the elevator operating panel.

At block 606, a second sensor or set of sensors makes a detection within a button detection zone. The button detection zone is a predefined volume or area around, near, and proximate a specific button on the elevator operating panel. The elevator operating panel can include one or more button detection zones, with each button detection zone associated with a specific button, and thus specific functionality (e.g., floor request, direction request, help request, etc.). The button detection zone is defined by and monitored by one or more associated button zone detection sensors that are arranged to detect when a passenger (e.g., a finger) approaches the specific button. In some embodiments, the buttons may be arranged with first and second portions as shown and described above, or, in some embodiments, the detection aspect of the button may be integrated into a single operable button to make an elevator request or perform other function associated with an elevator system. The second sensor(s) may be magnetic proximity sensor(s), motion detection proximity sensor(s), heat sensing proximity sensor(s), or light sensing proximity sensor(s).

At block 608, a second audio orientation signal is generated that is associated with a detection within a button detection zone at block 606. The second audio orientation signal may be generated to provide information associated with and specific to the button detection zone where a detection is made (e.g., "button information"). For example, if the elevator operating panel is a hall call panel, the second audio orientation signal may be a statement regarding a direction to which a passenger may wish to travel (e.g., "up" or "down"). If the elevator operating panel is a car operating panel, the second audio orientation signal may indicate a specific floor that can be selected to travel to by operating the button (e.g. "floor 15").

At block 610, the system may receive an input at one of the buttons on the elevator operating panel. The input may be a direction of travel (e.g., request made at a landing), may be a specific destination floor (e.g., request made within elevator car), or may be another input (e.g., elevator service request) associated with an elevator car or elevator system. The input may be received by a control system different from the audio orientation system that makes the detections and generates the audio orientation signals, such as a traditional elevator car controller, and the audio orientation system is a separate system that is in communication therewith. In some systems the audio orientation system may be a part or subpart of an elevator controller or control system.

At block 612, a third audio orientation signal is generated that corresponds with the input received at block 610. As such, the third audio orientation signal can be a confirmation signal that indicates the selection made at block 610.

Although a limited number of steps are provided with respect to flow process 600, those of skill in the art will appreciate that various other steps may be employed without departing from the scope of the present disclosure. For example, in some arrangements, an additional preliminary detection may be made to determine if a passenger is sight-impaired, such as through image recognition and/or detection of a personal device located on the passenger (e.g., smart phone, radio-frequency device, near-field communication device, etc.). Further, rather than a detection step at block 602, the operation of the audio orientation system may be triggered by opening of the elevator car door, and thus may not rely upon immediate proximity of a passenger.

Advantageously, embodiments provided herein can enable a new personalized voice indication system to safely guide sight-impaired passengers and clarify selection and operation of elevator operating panels (e.g., hall call panels, car operating panels, etc.). As described herein, speakers can be positioned in an elevator car and/or on or near elevator operating panels and are controlled to provide sounds to indicate a button that may be operated by a passenger.

In accordance with some embodiments, the use of the audio orientation system can be personalized and/or optimized. For example, any or all speakers of the systems can be operated to indicate the location of an elevator operating panel (e.g., within an elevator car or landing hallway). In accordance with some embodiments, various types of audio instructions or orientation indicators can be employed with embodiments of the present disclosure, including phrases, statements, sounds, alerts, etc. that can be associated with a particular button on an elevator operating panel, or otherwise associated with an elevator system. Further, in some embodiments, the audio orientation output generated by the speakers can include informative information in addition to merely indicating which button is being pointed at. For example, special messages could be setup to further help passengers, including generating audio information associated with a specific floor (e.g., "Floor 2, Cafeteria").

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator operating panel having at least one button; and an audio orientation system, the audio orientation system comprising:

at least one speaker positioned proximate the elevator operating panel;

at first proximity sensor configured to generate a panel detection zone, the first proximity sensor configured to detect the presence of a passenger in proximity to the elevator operating panel; and a second proximity sensor associated with an associated button of the elevator operating panel and positioned proximate thereto, the second proximity sensor arranged to generate a button detection zone around the associated button and detect a presence within the button detection zone, wherein the button detection zone becomes active for operation by the detected passenger in response to the detection by the first proximity sensor, and wherein, when a detection is made by the proximity sensor regarding a presence within the button detection zone, the audio system controls the at least one speaker to generate an audio orientation signal comprising button information that is related to the associated button within the button detection zone.

2. The elevator system of claim 1, wherein the associated button comprises a first portion and a second portion, wherein the first portion is an interactive element and the second portion comprises the second proximity sensor of the associated button.

3. The elevator system of claim 1, wherein the second proximity sensor is one of a magnetic proximity sensor, a motion detection proximity sensor, a heat sensing proximity sensor, or a light sensing proximity sensor.

4. The elevator system of claim 1, wherein the first proximity sensor is a camera.

5. The elevator system of claim 1, wherein the elevator operating panel is a hall call panel and the associated button is a direction button to make an elevator service request.

6. The elevator system of claim 1, wherein the elevator operating panel is a car operating panel and the associated button is a floor selection button of the car operating panel.

7. The elevator system of claim 1, wherein the at least one speaker is housed within the elevator operating panel.

8. The elevator system of claim 1, further comprising an elevator controller that receives input at the associated button regarding elevator requests.

9. A method of operating an elevator system, wherein the elevator system includes an elevator operating panel and an audio orientation system, the method comprising:

detecting a presence within a panel detection zone with a first proximity sensor, activating a button detection zone using a controller in response to the detection of the presence within the panel detection zone, wherein the panel detection zone is larger than the button detection zone;

detecting a presence within the button detection zone with a second proximity sensor, wherein the button detection zone is associated with an associated button of the elevator operating panel; and generating an audio orientation signal from at least one speaker, wherein the audio orientation signal includes button information indicating information associated with the associated button where the presence is detected.

10. The method of any of claim 9, further comprising:

receiving an input at the associated button where the presence is detected; and controlling an elevator car in response to the input.

11. The method of claim 10, further comprising:

generating a third audio orientation signal indicating selection of the associated button where the presence is detected.

12. The method of claim 9, wherein the elevator operating panel is a hall call panel and the associated button is a direction button to make an elevator service request.

13. The method of claim 9, wherein the elevator operating panel is a car operating panel and the associated button is a floor selection button of the car operating panel.

* * * * *